US006470950B2

(12) United States Patent
Shimizu

(10) Patent No.: US 6,470,950 B2
(45) Date of Patent: Oct. 29, 2002

(54) ROLLED SCREEN DRAWER

(76) Inventor: Kenichi Shimizu, 2-3-701, Hirarigaoka 5-chome, Nerima-ku, Tokyo 179-0072 (JP)

( * ) Notice: Subject to any disclaimer, the term of this patent is extended or adjusted under 35 U.S.C. 154(b) by 0 days.

(21) Appl. No.: 09/851,118

(22) Filed: May 9, 2001

(65) Prior Publication Data

US 2001/0042603 A1 Nov. 22, 2001

(30) Foreign Application Priority Data

May 9, 2000 (JP) ..... 2000-135638
Sep. 21, 2000 (JP) ..... 2000-287061

(51) Int. Cl.[7] ..... E06B 9/08
(52) U.S. Cl. ..... 160/121.1; 160/25; 160/311
(58) Field of Search ..... 160/121.1, 24, 160/25, 120, 122, 290.1, 310, 311

(56) References Cited

U.S. PATENT DOCUMENTS 3,265,116 A * 8/1966 Guffan ..... 160/121.1
4,194,550 A * 3/1980 Hopper ..... 160/121.1
4,203,234 A 5/1980 Thenon ..... 35/76
5,203,395 A * 4/1993 Koller et al. ..... 160/121.1
5,450,890 A * 9/1995 Pinkalla et al. ..... 160/121.1
5,682,939 A * 11/1997 Vargo ..... 160/121.1

FOREIGN PATENT DOCUMENTS

DE 4019590 A1 1/1992
JP 09060429 3/1997

OTHER PUBLICATIONS

European Search Report dated Aug. 22, 2001.

* cited by examiner

*Primary Examiner*—David M. Purol
(74) *Attorney, Agent, or Firm*—Armstrong, Westerman & Hattori, LLP

(57) ABSTRACT

A rolled screen drawer includes a take-up roll (1) rotatably mounted on a support member (2), a first screen (3) wound on the outermost periphery of the take-up roll, at least one additional screen (4) wound on an inside of the first screen, an engagement (Sa, Sb, Sc) capable of engaging the inside of the leading end of at least one additional screen with the outside of the first screen, and a leading member (6*b*, 6*c*) provided at the leading end of at least one additional screen. It is thus possible to selectively expose any desired screen to view.

7 Claims, 12 Drawing Sheets

ROLLED SCREEN DRAWER

BACKGROUND OF THE INVENTION

The present invention relates to a rolled screen drawer capable of selectively rolling down a plurality of screens having functions of displaying images, shielding windows from light, etc.

So far, a rolled screen drawer has been known, wherein a display screen is wound on a take-up roll mounted on a support in such a way that it can be rolled down from the take-up roll and stopped or rewound thereon. If required, the screen is rolled down from the take-up roll and stopped to expose the information displayed thereon to observers' view. This drawer may be modified such that a plurality of screens are wound on the take-up roll in a superposed manner. When the screen nearest to the observers' side or the first screen is exposed to view, all the screens are rolled down from the take-up roll. To expose a screen behind the first screen to view all screens before that screen must first be rolled down from the take-up roll by the hand and then turned back around the take-up roll.

Such a drawer having a plurality of screens wound on the take-up roll is very difficult to handle, because when a screen behind the first screen is exposed to view, all screens before that screen must first be rolled down from the take-up roll and then turned back around the take-up roll as explained above. As this turning-back operation is repeated, the-screens are heavily damaged. For these reasons, the rolled screen drawer having a plurality of screens wound on the take-up roll is presently too clumsy to be in common use.

In view of such problems with the prior art, an object of the present invention is to provide a rolled screen drawer comprising a plurality of screens having various functions and a take-up roll on which the plurality of screens are wound, wherein any desired screen can be rolled down from the take-up roll in an easy, smooth fashion.

SUMMARY OF THE INVENTION

According to the first aspect of the invention as defined in claim 1, this object is achieved by the provision of a rolled screen drawer characterized by comprising, as shown in FIGS. 1 to 6:

a take-up roll (1) rotatably mounted on a support member (2), a first screen (3) wound on the outermost periphery of said take-up roll, at least one additional screen (4) wound on an inside of said first screen, engagement means (5*a*, 5*b*, 5*c*) capable of engaging an inside of a leading end of said at least one additional screen with an outside of said first screen, and a leading member (6*b*, 6*c*) provided at a leading end of said at least one additional screen.

According to the second aspect of the invention recited in claim 2, there is provided a rolled screen drawer characterized by comprising, as shown in FIGS. 7 and 8:

a take-up roll (1) rotatably mounted on a support member (2), a motor (11) for driving said take-up roll in a reversible manner, a first screen (3) wound on the outermost periphery of said take-up roll, at least one additional screen (4) wound on an inside of said first screen, engagement means (5*b*, 5*c*) comprising electromagnets, which is provided on an inside of said at least one additional screen, and engagement means (5*a*) provided on an outside of said first screen (3) for engagement with said engagement means.

According to the third aspect of the invention as recited in claim 3, there is provided a rolled screen drawer characterized by comprising, as shown in FIGS. 9 and 10:

a take-up roll (1) and a pull-out roll (8) rotatably mounted on a support member (10), a first screen (3) wound on the outermost periphery of said take-up roll, at least one additional screen (4) wound on an inside of said first screen, engagement means (5*b*, 5*c*) comprising electromagnets, which is provided on an inside of a leading end of said at least one additional screen, engagement means (5*a*) comprising a magnetic material, which is provided on an outside of said first screen (3) and engaged with said engagement means, and a rope (34) for coupling a leading end of said first screen to said pull-out roll.

According to the fourth aspect of the invention as recited in claim 4, there is provided a rolled screen drawer characterized by comprising, as shown in FIG. 11:

a take-up roll (1) rotatably mounted on a support member (2), a motor (11) for rotating said take-up roll in a reversible manner, a first screen (3) wound on the outermost periphery of said take-up roll, at least one additional screen (4) wound on an inside of said first screen, engagement means comprising a suction port (13*a*), which is provided on an inside of a leading end of said at least one additional screen, and a control valve and a vacuum pump connected to said suction port.

According to the fifth aspect of the invention as recited in claim 5, there is provided a rolled screen drawer characterized by comprising, as shown in FIGS. 12 to 15:

a take-up roll (1) and a pull-out roll (8) rotatably mounted on a support member (9), a first screen (3) wound on the outermost periphery of said take-up roll, at least one additional screen (4) wound on an inside of said first screen, engagement means (5*b*, 5*c*) capable of engaging an inside of a leading end of said at, least one additional screen with an outside of said first screen, leading members (6*a*, 6*b*, 6*c*) provided on leading ends of said first screen and said at least one additional screen, a rope (34) for coupling said leading member (6*a*) of said first screen to said pull-out roll (8), and disengagement means (7) for giving a selective push on said respective leading members.

It is here noted that the numeral references, corresponding to those in the drawings, are given for an easy understanding of the invention and not by way of limitation.

EMBODIMENTS OF THE INVENTION

Figure 1:
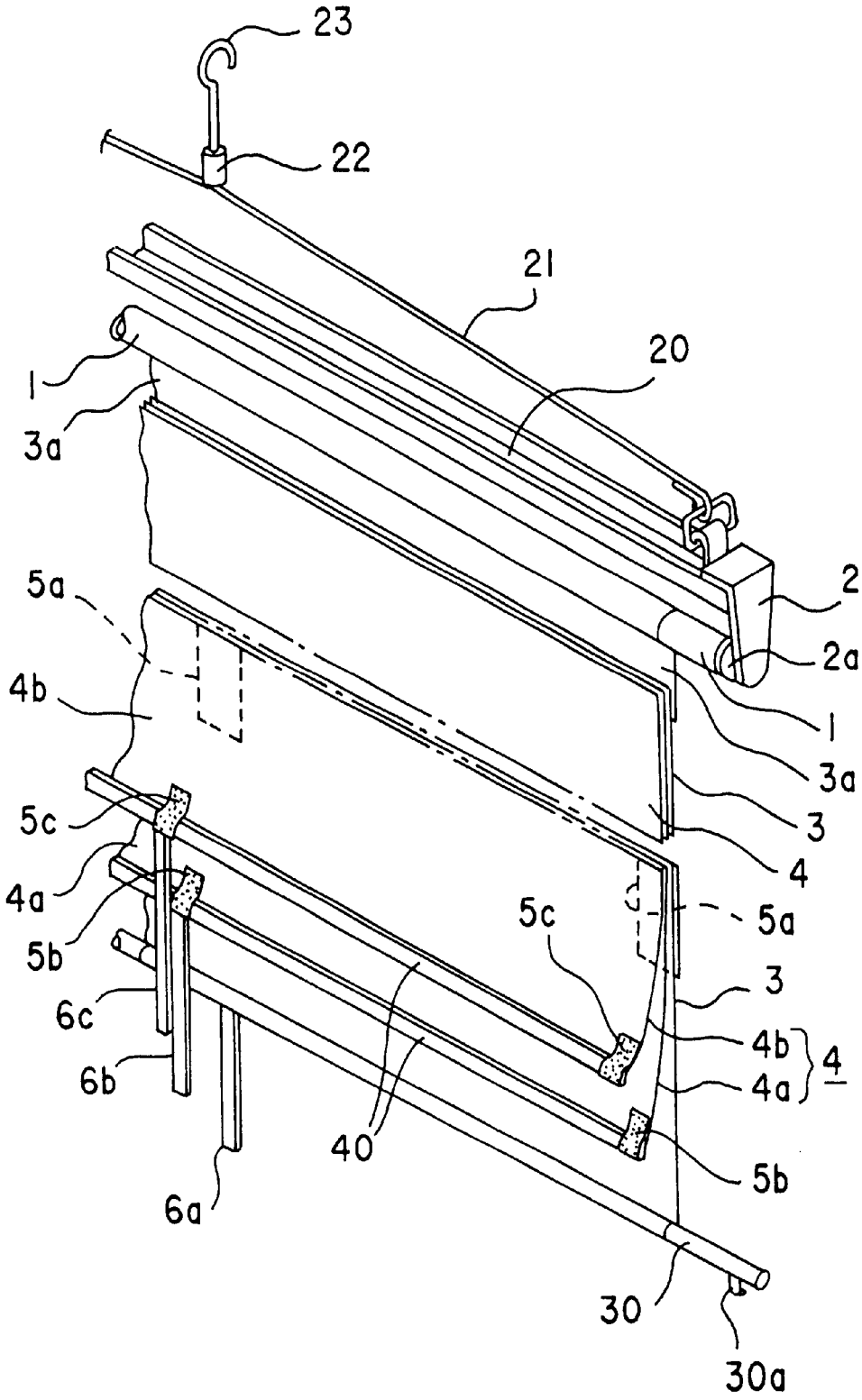
FIG. 1 is a fragmentary perspective view illustrative of one embodiment of the rolled screen drawer according to the invention.
Figure 2:
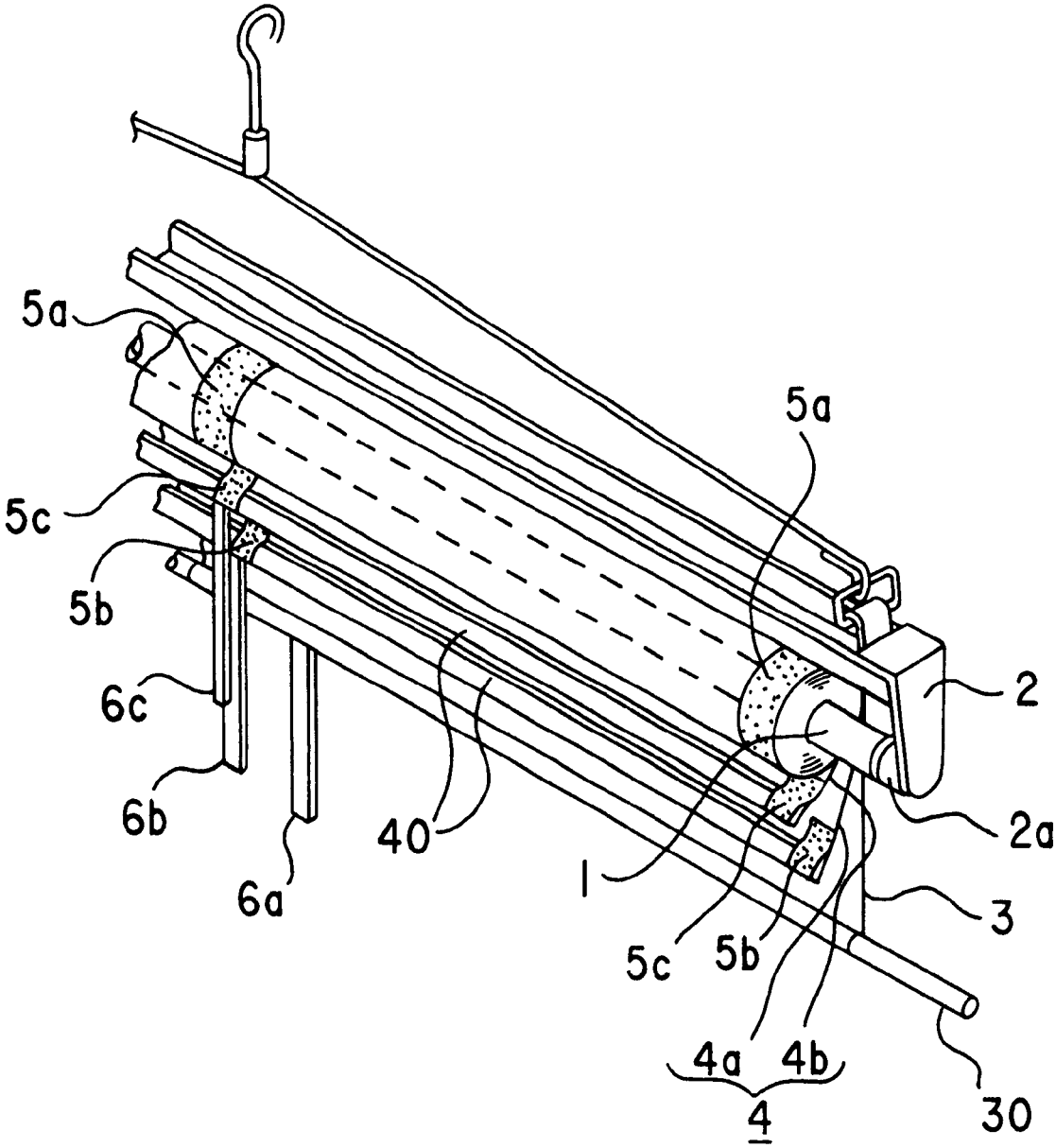
FIG. 2 is illustrative of how to operate the drawer of FIG. 1.
Figure 3:
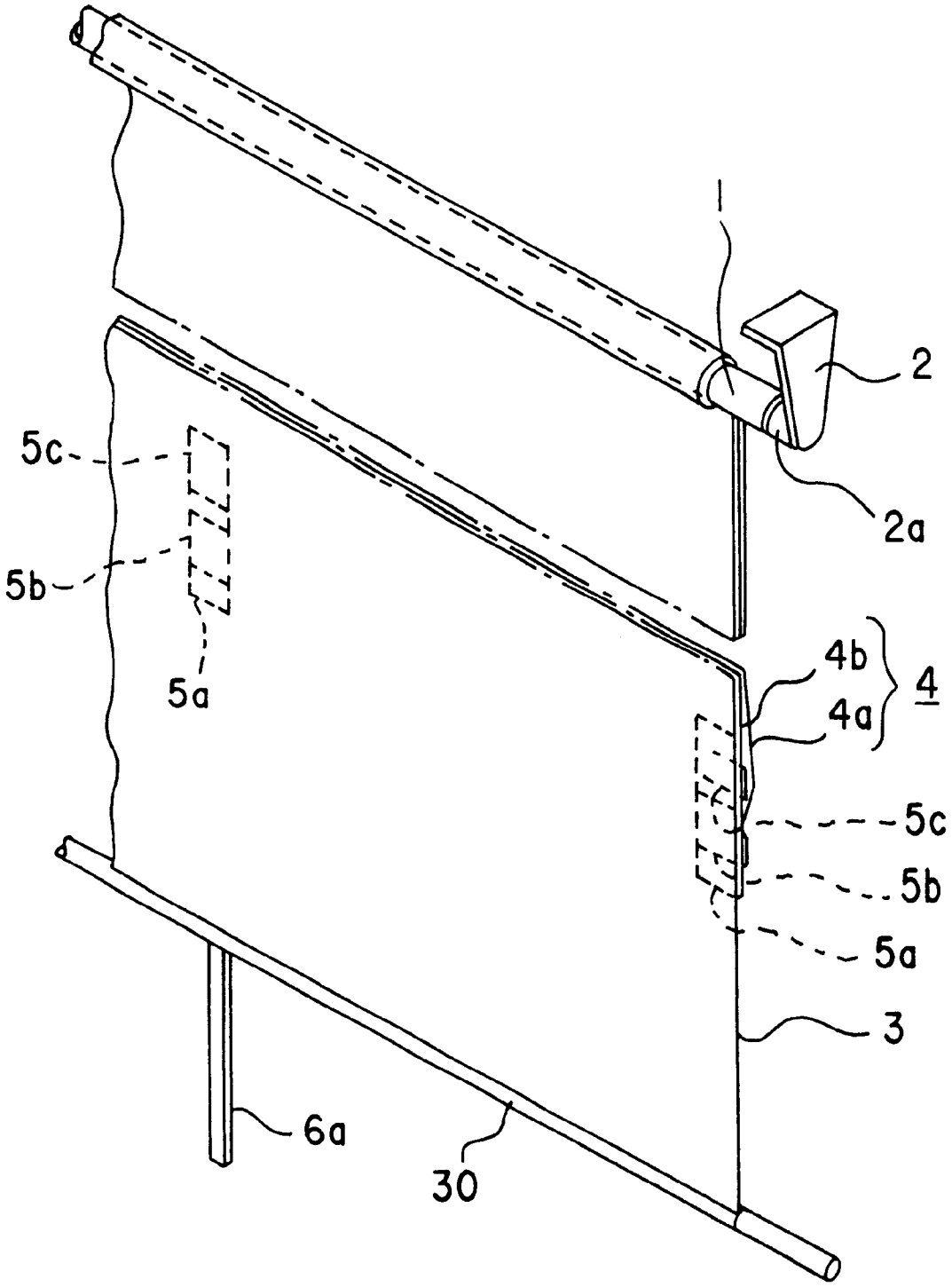
FIG. 3 is illustrative of how to operate the drawer of FIG. 1.
Figure 4:
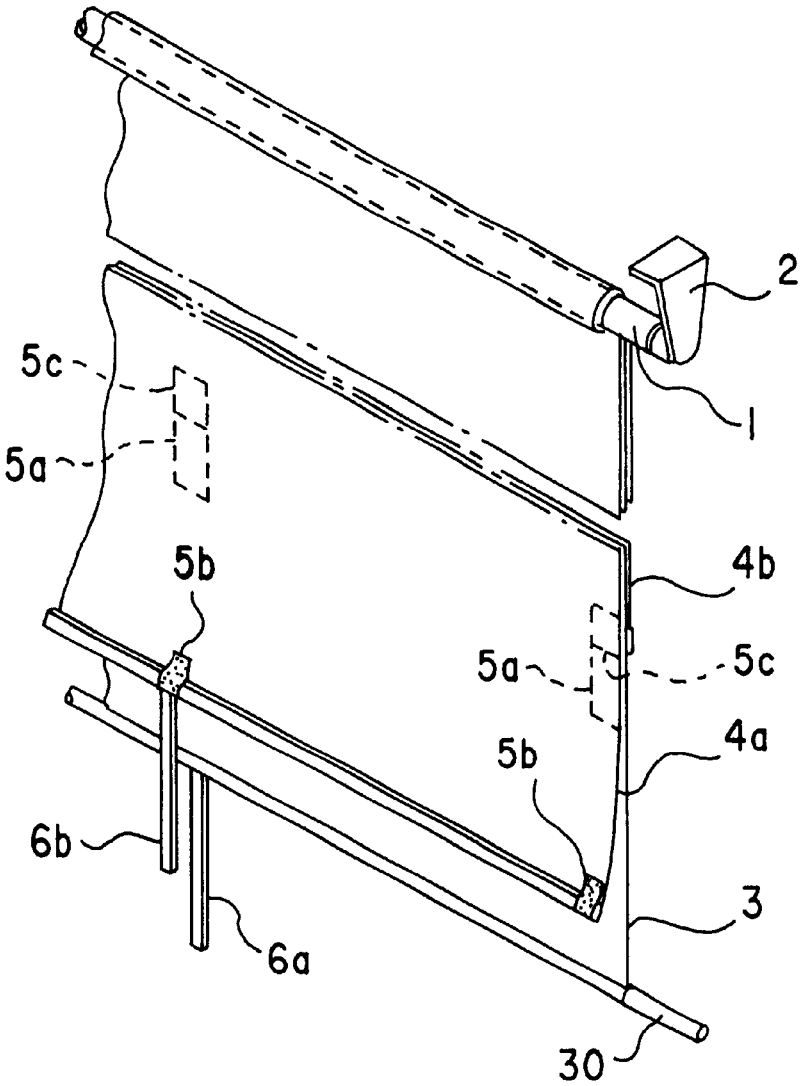
FIG. 4 is illustrative of how to operate the drawer of FIG. 1.

Preferred embodiments of the present invention are now explained with reference to the accompanying drawings wherein FIGS. 1 to 4 are illustrative of one embodiment of the rolled screen drawer according to the invention. FIG. 1 is a fragmentary perspective view of the embodiment, FIG. 2 is a fragmentary perspective view illustrative of just before the leading end of each screen is wound on the take-up roll in the drawer of FIG. 1, and FIGS. 3 and 4 are illustrative of how to operate the drawer of FIG. 1.

A take-up roll 1 is rotatably and unrotatably mounted on a bearing member 2*a* mounted on support members 2 and 2 (only one of which is shown), and the upper portions of the support members 2 and 2 are coupled to each other via a coupling frame 20. The upper portions of the support members 2 and 2 are connected with one ends of hanging ropes 21 having the same length, and each hanging rope 21 is connected at the other end with a hanging hook 23 via a universal joint 22 that is turnable in every direction. The hanging hook 23 is hooked on a catch or dedicated stand provided on a wall or window. It is here noted that the support member 2 may be fixed directly on a wall, a window or the like.

At least two screens or a first screen 3 and a second screen 4 are mounted on the take-up roll 1 in such a superposing manner that the first screen 3 wound on the outermost periphery of the take-up roll 1 and the second screen 4 wound on the inside of the first screen 3 are windable and drawable. One end of a short base sheet 3*a* having substantially the same width as each screen 3, 4 is fixed to the take-up roll 1, and each screen 3, 4 is detachably fixed to the other end of the base sheet 3*a* by means of fabric fasteners (Magic Tape™), buttons, chucks, weak adhesive tapes. This makes screen replacement easy so that various pieces of information can be displayed.

In this embodiment, the second screen 4 is made up of two screens 4*a* and 4*b*. The second screen 4*a* is put on the inside of the first screen 1, and the third screen 4*b* is put on the inside of the second screen 4*a*. It is here noted that the second screen 4 may be made up of one second screen 4*a* or three or more screens put one upon another although not illustrated.

A weight bar 30 is fixed to the leading end of the first screen 1, and reinforcing bars 40 are fixed to the leading ends of the second screens 4 (4*a*, 4*b*). The weight bar 30 has extensions at both its ends to prevent the first screen 3 from being pulled in the take-up roll 1, and each reinforcing bar 40 has a length substantially equal to the width of each second screen 4. It is here noted that reference numeral 30*a* stands for a lock member that is fixed to a floor, wall or window frame to keep the screen stable, and that the aforesaid base sheet 3*a* may also be fixed to the weight bar 30 so that the base sheet 3*a* and the first screen 3 are detachably fixed to each other.

The leading end of the second screen 4 and the outside of the first screen 3 are provided at the necessary sites with engagement means 5*a*, 5*b* and 5*c* which, when the first screen 3 is rolled down while the second screen 4 remains wound on the take-up roll 1, engage the leading end of the second screen 4 with the outside of the first screen 3.

In this embodiment of the invention, the engagement means 5*a*, 5*b* and 5*c* are all formed of fabric fasteners (Magic Tape™). These means are glued to a total of three sites, i.e., to both ends and a middle site of the inside of the leading end of the second screen 4 (4*a*, 4*b*), and to both ends and a middle site of the back side of the first screen 3 at positions spaced away from the leading end thereof by the required amount toward the take-up roll 1 side.

The engagement means 5*a* fixed to the outside of the first screen 3 is longer in the leading direction than the engagement means 5*b*, 5*c* fixed to the second screen 4. Accordingly, where the second and third screens 4*a* and 4*b* are full wound on the take-up roll 1 as shown in FIG. 2, the engagement means 5*b*, 5*c* on these screens 4*a*, 4*b* are in engagement with the engagement means 5*a* on the outside of the first screen 3.

The engagement means 5*a*, 5*b* and 5*c* are not always limited to fabric fasteners, if, upon rolling down, they can engage and associate the leading ends of the second screens 4 with the outside of the first screen 3. For instance, magnets (plate-like permanent magnets), and weak adhesive materials may be used. These engagement means may be provided across the screens. For the engagement means 5*a*, 5*b*, 5*c*, electrostatic suction sheets may be used. When each screen 3, 4 is all constructed of an electrostatic suction sheet, the outside of the first screen 3 and the insides of the second screens generally present engagement means.

The weight bar 30 of the first screen is provided substantially at its center with a leading member 6*a* having the necessary length, for instance, a strip, tape or rope. The reinforce bar 40 of each second screen 4 is also provided substantially at its center with a leading member 6*b*, 6*c* such as a strip, tape or rope. In this embodiment, at least portions of the hanging leading members 6*a*, 6*b*, 6*c* are located at overlapping or adjacent positions. It is acceptable to put on each of the leading members 6*a*, 6*b* and 6*c* the title or summary of what is displayed on the corresponding screen. It is here noted that an extension may be provided on the weight bar instead of the leading member 6*a,* and extensions may be integrally provided to the ends of the second screens 4 in place of the leading members 6*b,* 6*c.*

The take-up roll 1 includes a built-in mechanism for stopping the rolling-down screens 3, 4 at any desired positions and rewinding them. Such a mechanism is known in the field of roll blinds for blocking windows from light (see JP-B 63-34950, JU-B 1-26871 and JP-A 9-324588 for instance).

This mechanism is built up of a take-up spring for winding the screens 3, 4 on the take-up roll 1 and a clutch device for stopping the take-up roll 1 at any desired position with respect to the bearing member 2*a* where the screens can be wound on the take-up roll 1. After the screens 3, 4 have been rolled down, the screens 3, 4 come to a stop on release of the hand therefrom at any desired position. Upon a slight pulling-down of the screens 3, 4 from the stop positions followed by release of the hand, they can be rewound on the take-up roll 1.

It is acceptable to mount only the take-up spring in the take-up roll 1 and dispense with the clutch device. In this case, the leading member 6a or the weight bar 30 is provided with a hook. After the screens 3, 4 have been rolled down, the hook is fixed to a ring or the like provided on a floor or window frame.

How to operate the rolled screen drawer according to this embodiment is now explained. FIG. 2 is illustrative of the second and third screens 4*a* and 4*b* just before they are full wound on the take-up roll 1. Where the second and third screens 4*a* and 4*b* are full wound on the take-up roll 1, the engagement means 5*b* and 5*c* on the second and third screens 4*a* and 4*b* are in engagement with the engagement means 5*a* on the outside of the first screen 3.

Operation 1

To expose the inside of the first screen 3 to view, the first screen 3 is rolled down via the leading member 6*a* from the take-up roll 1 on which the first screen 3, second screen 4*a* and third screen 4*b* are full wound, whereupon the leading ends of the second and third screens 4*a* and 4*b* are rolled down while they are engaged with the outside of the first screen 3 by the engagement means 5*a,* 5*b* and 5*c,* as shown in FIG. 3, so that the front surface of the first screen 3 can be exposed to view.

Operation 2

To expose the inside of the second screen 4*a* of the second screens 4 to view, the second screen 4*a* is rolled down via the leading member 6*b* from the take-up roll 1 on which the first screen 3, second screen 4*a* and third screen 4*b* are full wound, whereupon the leading end of the third screen 4*b* is rolled down while it is engaged with the outside of the first screen 3 by the engagement means 5*a* and 5*c,* as shown in FIG. 4, so that the inside of the second screen 4*a* can be exposed to view.

Operation 3

To expose the inside of the third screen 4*b* of the second screens 4 to view, the second screen 4*b* is rolled down via the leading member 6*c* from the take-up roll 1 on which the first screen 3, second screen 4*a* and third screen 4*b* are full wound, whereupon the engagement means 5*a,* 5*b* and 5*c* are disengaged from one another, as shown in FIG. 1, so that the second and third screens 4*a* and 4*b* are rolled down following the inside of the first screen 3, so that the inside of the third screen 4*b* can be exposed to view.

While the embodiment of the invention has been described with reference to the screens 3 and 4 with the objects to be displayed being put on the insides thereof, it is understood that the objects to be displayed may also be put on the outsides of the screens 3 and 4. If, in this case, the rolled screen drawer is reversed, it is then possible to display various pieces of information by the selective rolling-down of screens by the aforesaid operations.

Figure 5:
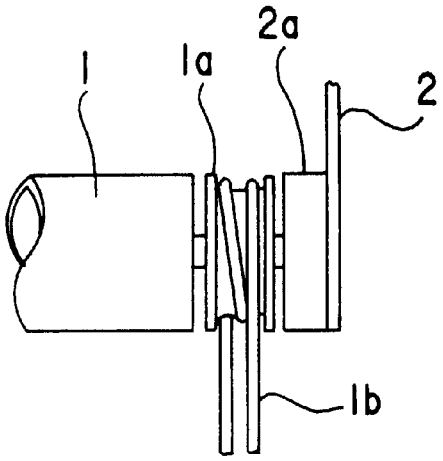
FIG. 5 is a fragmentary front view illustrative of one modification to the embodiment of FIG. 1

FIG. 5 is a fragmentary front view of one modification to the embodiment of FIG. 1. In this modified embodiment, between a take-up roll 1 and a bearing member 2*a* there is fixedly provided a wheel 1*a* on which a manipulation strip or chain 1*b* is wound. This modification is suitable for the case where the screens are long in the vertical direction and the take-up roll 1 is located at a relatively high position. The screens can be easily rolled down by the manipulation strip or chain 1*b*.

Figure 6:
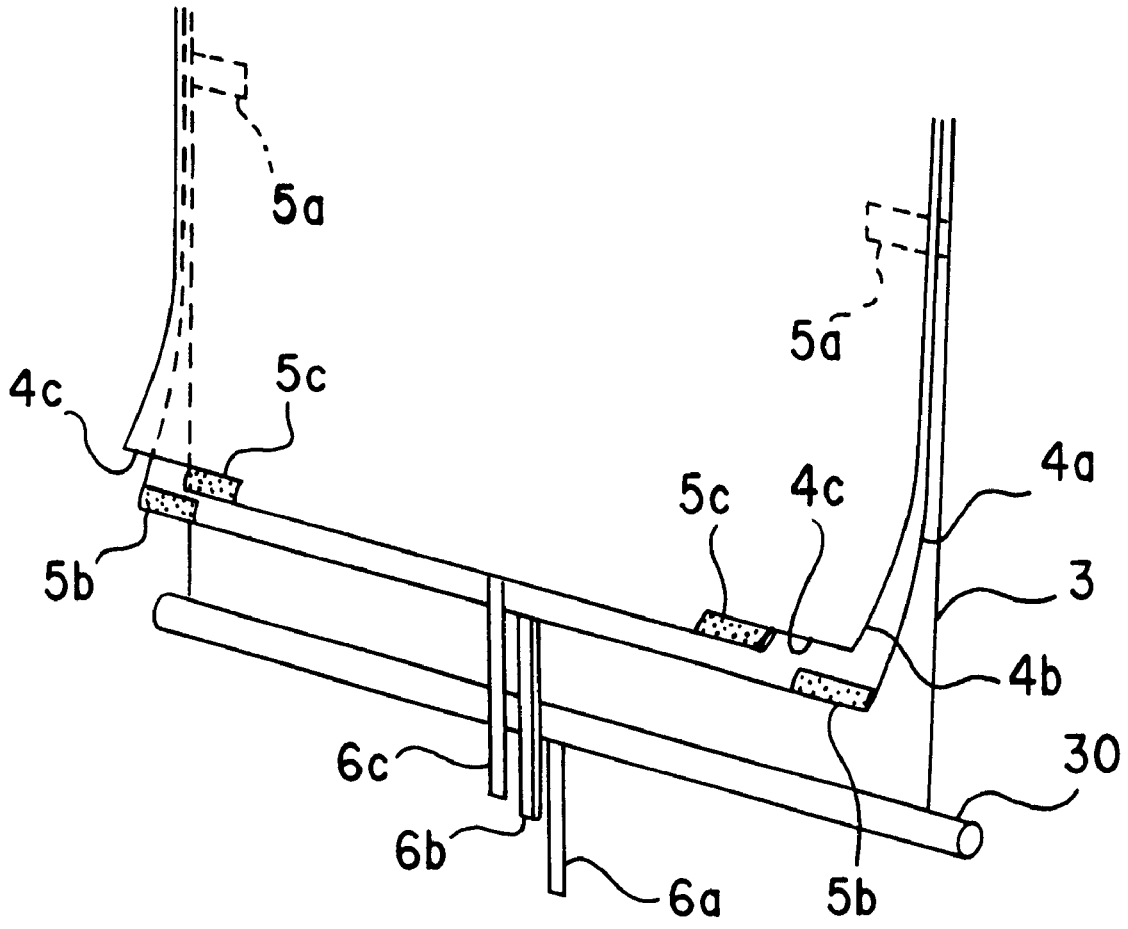
FIG. 6 is a fragmentary perspective view illustrative of another modification to the embodiment of FIG. 1.

FIG. 6 is a fragmentary perspective view illustrative of one modification to the embodiment of FIG. 1. In the embodiment of FIG. 1, the second screens 4 are shorter in rolled-down length than the first screen 3 and the third screen 4*c* is shorter in rolled-down length than the second screen 4*b* by a given amount. In the embodiment of FIG. 6, however, the screens 3, 4*a* and 4*b* have the same rolled-down length, and the reinforcing bars 40 are removed from the second screens 4. In this case, the leading end of the third screen 4*b* is provided on both sides with cutouts 4*c* in which engagement means 5*c* are provided. Engagement means 5*a,* with which engagement means 5*b* and 5*c* are engaged, are provided on the outside of the first screen 3.

Figure 7:
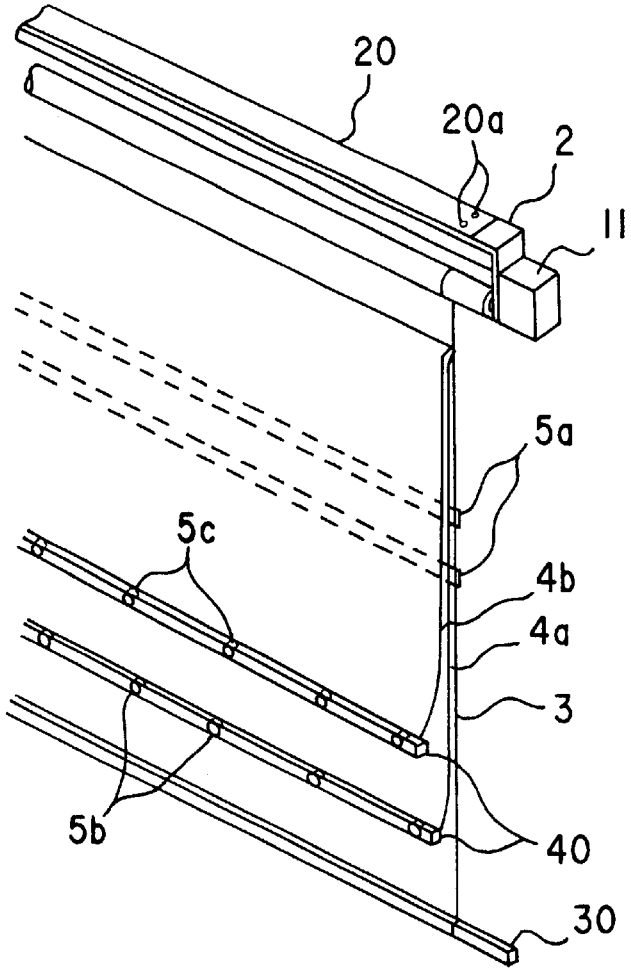
FIG.7 is a fragmentary perspective view illustrative of another embodiment of the rolled screen drawer according to the invention.
Figure 8:
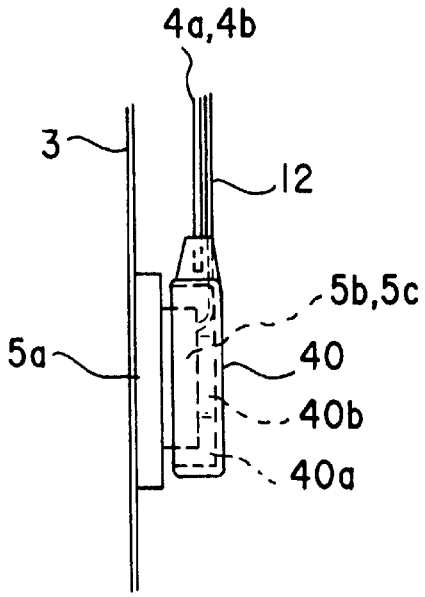
FIG. 8 is a side view of part of engagement in FIG. 7.

FIG. 7 is a fragmentary perspective view illustrative of another embodiment of the rolled screen drawer according to the invention, and FIG. 8 is a side view showing part of engagements according to this embodiment. In the following description, the same parts as in the first embodiment are indicated by the same numeral references, and so explanations thereof are omitted. For this embodiment of the rolled screen drawer, the combined clutch device and take-up spring mechanism in the first embodiment is not used. Instead, the operation for rolling down and rewinding screens is carried out in an automatically controlled mode using a motor, and the selective rolling-down of screens is carried out by means of an operating switch or remote controller connected to the drawer.

A coupling frame 20 is coupled to the upper portion of a support member 2, and screwed to a window frame or the like through screw holes 20*a*. Alternatively, the support frame 2 is hooked up on a wall or window using a hanging rope 21 or hook 23, as shown in FIG. 1. On the side of the support member 2 there is fixedly provided a reversible motor 11, with the rotary shaft thereof fixed to a take-up roll 1. The leading ends of the second and third screens 4*a* and 4*b* are provided on their insides with engagement means 5*b,* 5*c* comprising a plurality of electromagnets.

AS shown in FIG. 8, the engagement means 5*b,* 5*c* comprising electromagnets are fixedly provided within a recess 40*a* in a reinforcing bar 40 by means of a resilient member such as a spring, rubber or sponge, so that adhesion to the engagement means 5*a* can be increased even when the screen 3 is wound up. Although not illustrated, the coils of the electromagnets are connected via a wire 2 laid on or in the screen to an external remote controller or the like.

The first screen 3 is provided on its outside with two horizontal engagement means 5*a* comprising a magnetic material which, where the second screens 4*a,* 4*b* are wound on the takeup roll 1, engage the engagement means 5*b,* 5*c* comprising electromagnets with the outside of the first screen 3. These engagement means 5*a* are formed on or in the screen 3.

How to operate the rolled screen drawer according to this embodiment is now explained.

Operation 1

To expose the inside of the first screen 3 to view, currents are fed to the engagement means 5*b*, 5*c* comprising electromagnets where the first screen 3, second screen 4*a* and third screen 4*b* are full wound on the take-up roll 1, thereby engaging them with the engagement means 5*a* on or in the first screen 3. Then, the motor 11 is driven in the rolling-down direction to draw out the leading ends of the second and third screens 4*a* and 4*b* while they remain engaged with the outside of the first screen 3, so that the inside of the first screen 3 can be exposed to view.

Operation 2

To expose the inside of the second screen 4*a* of the second screens 4 to view, currents are fed to the engagement means 5*c* comprising electromagnets where the first screen 3, second screen 4*a* and third screen 4*b* are full wound on the take-up roll 1, thereby engaging them with the engagement means 5*a* on or in the first screen 3. Then, the motor 11 is driven in the rolling-down direction to draw out the leading end of the third screen 4*b* while it remains engaged with the outside of the first screen 3 by the engagement means 5*a*, 5*c*,so that the inside of the second screen 4*a* can be exposed to view.

Operation 3

To expose the inside of the second screen 4*b* of the second screens 4 to view, currents fed to the engagement means 5*b*, 5*c* comprising electromagnets are put off where the first screen 3, second screen 4*a* and third screen 4*b* are full wound on the take-up roll 1. Then, the motor 11 is driven in the rolling-down direction to disengage the engagement means 5*a*, 5*b*, 5*c* from one another, whereupon the second and third screens 4*a*, 4*b* are rolled down following the inside of the first screen 1, so that the inside of the third screen 4*b* can be exposed to view.

Figure 9:
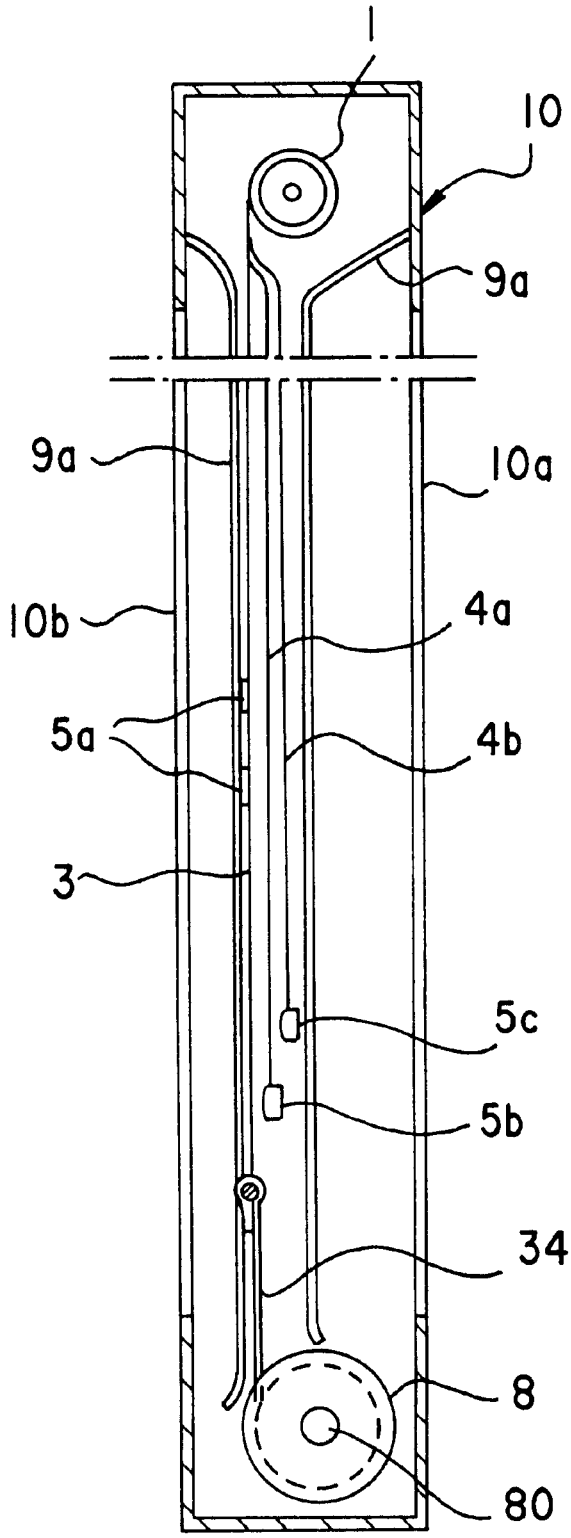
FIG. 9 is a longitudinally sectioned view illustrative of yet another embodiment of the rolled screen drawer according to the invention.
Figure 10A:
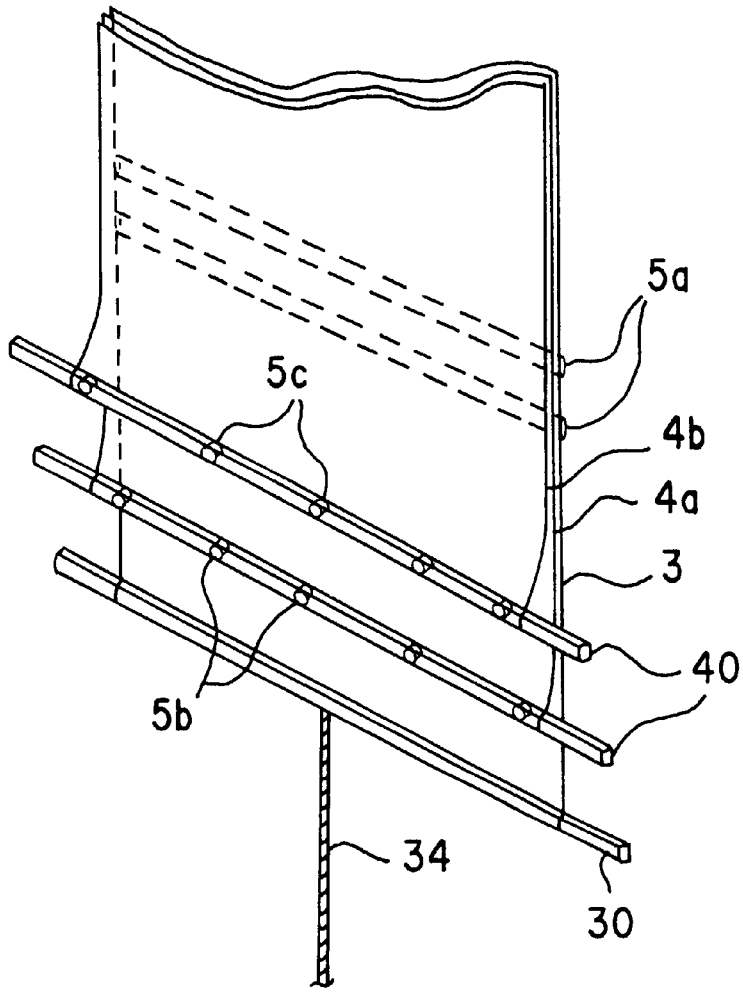
FIG. 10(A) is a perspective view illustrative of a portion of each screen of FIG. 9 rolled down.
Figure 10B:
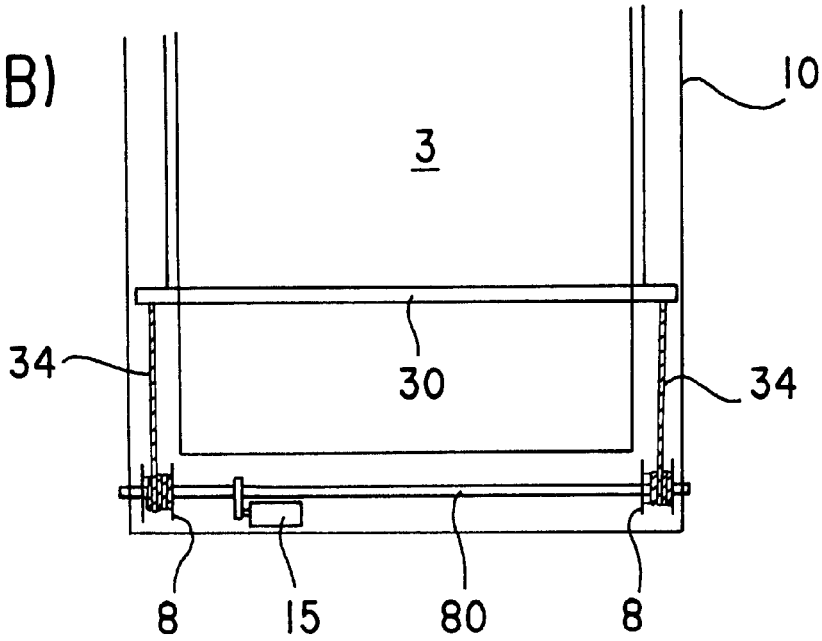
FIG. 10(B) is a view illustrative of one modification to FIG. 10(A).

FIGS. 9 and 10 show together yet another embodiment of the rolled screen drawer according to the invention. FIG. 9 is a longitudinally sectioned view of this embodiment, FIG. 10(A) is a perspective view of a portion of each screen rolled down, and FIG. 10(B) is illustrative of one modification to this embodiment.

In this embodiment of the invention, a rolled screen drawer is housed within a rectangular frame 10 having a front opening 10*a* and a rear opening 10*b*. It is here noted that the rear opening 10*b* may be closed up. In the frame 10, a take-up roll 1 is received at an upper site and a pull-out roll 8 fixed to a rotary shaft 80 is received at a lower site. A leading end of the first screen 3 is connected with one end of a rope 34, the other end of which is wound on the pull-out roll 8. The take-up roll 1 and pull-out roll 8 are each connected to a motor (not shown) driven in a reversible manner to roll down or rewind screens 3, 4. On both sides of the interior of the frame 10 there are a pair of parallel guides 9*a* and 9*a* along the rolling-down region of each screen 3, 4*a*, 4*b*. While each screen 3, 4*a*, 4*b* is rolled down, the weight bar 30 of screen 3, and the reinforcing bar 40 of screen 4*a* or 4*b* is guided along both guides 9*a* and 9*a*. It is here noted that the explanation of engagement means 5*a*, 5*b* and 5*c*, because of being the same as in the embodiment of FIG. 8, is omitted.

FIG. 10(B) is illustrative of one modification to this embodiment of the invention, wherein pull-out rolls 8 are provided on both sides of a rotary shaft 80, and both side ends of a weight bar 30 are coupled to the pull-out rolls 8 by means of ropes 34. It is here noted that reference numeral 15 stands for a motor coupled to the rotary shaft 80 via a gear. The instant embodiment has an additional feature of keeping the rope 34 invisible from the outside.

How to operate the rolled screen drawer according to this embodiment is now explained.

Operation 1

To expose the inside of the first screen 3 to view, currents are fed to the engagement means 5*b*, 5*c* comprising electromagnets where the first screen 3, second screen 4*a* and third screen 4*b* are full wound on the take-up roll 1, thereby engaging these means with the engagement means 5*a* on the first screen 3. Then, the pull-out rolls 8 are rotated in the winding direction of the ropes 34, whereupon the leading ends of the second and third screens 4*a* and 4*b* are pulled down while they remain engaged with the outside of the first screen 3, so that the inside of the first screen 3 can be exposed to view.

Operation 2

To expose the inside of the second screen 4*a* of the second screens 4 to view, currents are fed to the engagement means 5*c* comprising electromagnets where the first screen 3, second screen 4*a* and third screen 4*b* are full wound on the take-up roll 1, thereby engaging these means with the engagement means 5*a* on the first screen 3. Then, the pull-out rolls 8 are rotated in the winding direction of the ropes 34, whereupon the leading end of the third screen 4*b* is pulled down while it remains engaged with the outside of the first screen 3 by the engagement means 5*a*, 5*c*, so that the inside of the second screen 4*a* can be exposed to view.

Operation 3

To expose the inside of the second screen 4*b* of the second screens 4 to view, currents fed to the engagement means 5*b*, 5*c* comprising electromagnets are put off where the first screen 3, second screen 4*a* and third screen 4*b* are full wound on the take-up roll 1, thereby engaging these means with the engagement means 5*a* on the first screen 3. Then, the pull-out rolls 8 are rotated in the winding direction of the ropes 34, whereupon the engagement means 5*a*, 5*b*, 5*c* are disengaged from one another to pull down the second and third screens 4*a*, 4*b* following the inside of the first screen 3, so that the inside of the third screen 4*b* can be exposed to view.

Figure 11:
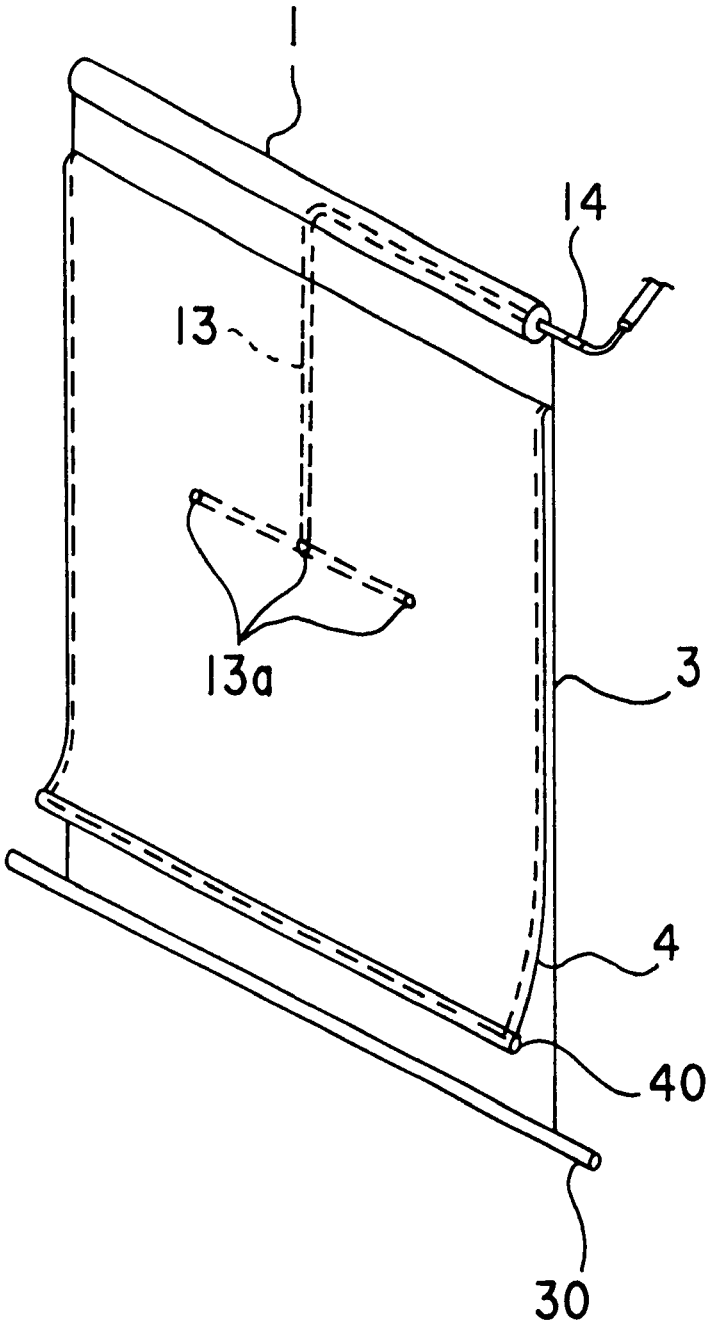
FIG. 11 is a fragmentary perspective view of a further embodiment of the rolled screen drawer according to the invention.

FIG. 11 is a fragmentary perspective view illustrative of yet another embodiment of the rolled screen drawer according to the invention. In this embodiment, a suction hose 13 is disposed on the outside of the second screen or screens 4, and then connected to a rotary joint 14, a control valve (not shown) and a vacuum pump (not shown) through a take-up roll 1. The suction hose 13 is provided at its end with a plurality of suction ports 13*a* open on the inside of the second screen or screens 4. It is here noted that the number and locations of the suction ports 13*a* are not always limited to those illustrated; various forms of suction ports may be used or they may be provided in a reinforcing bar 40. It is acceptable to provide sealing members around the first screen 3 and at least one of the second screens. This rolled screen drawer is operated as in the embodiment of FIG. 7 by putting on or off the control valve instead of using electromagnets.

Figure 12:
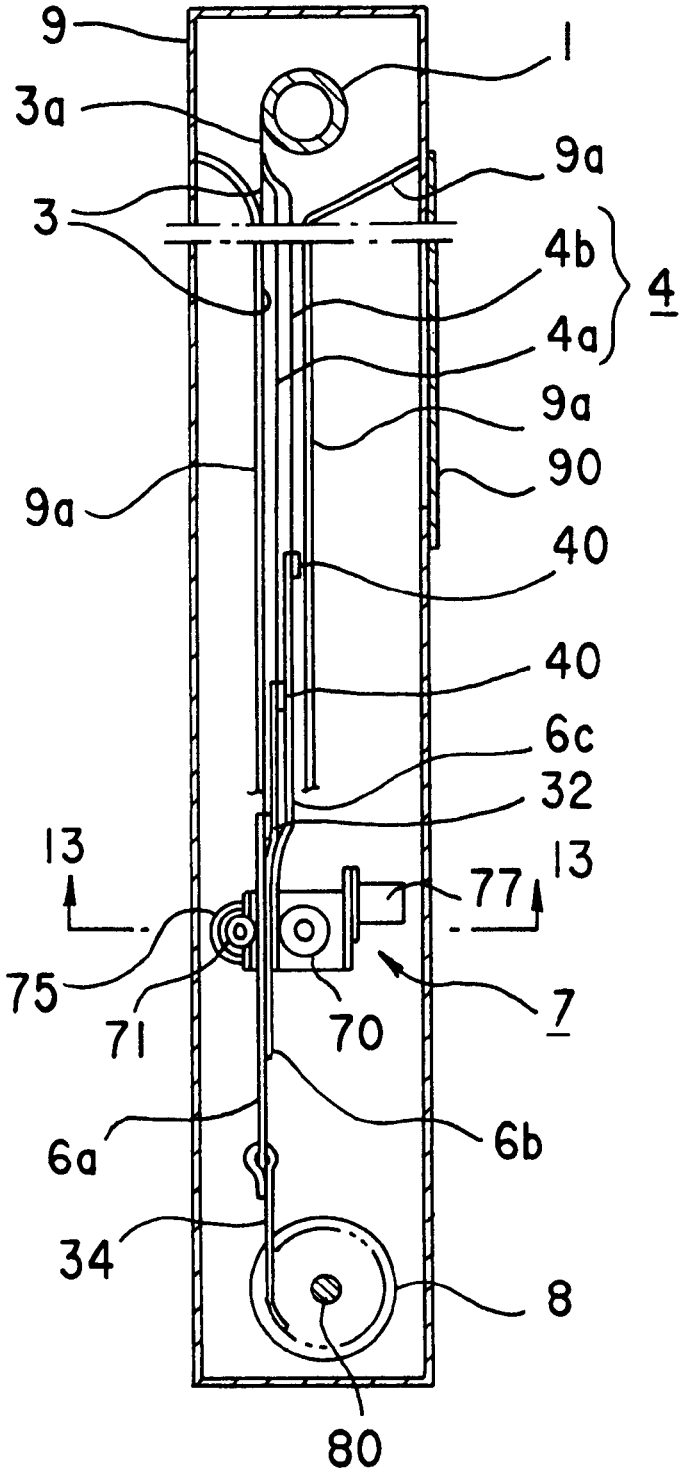
FIG. 12 is a fragmentary perspective view of a further embodiment of the rolled screen drawer according to the invention.
Figure 13:
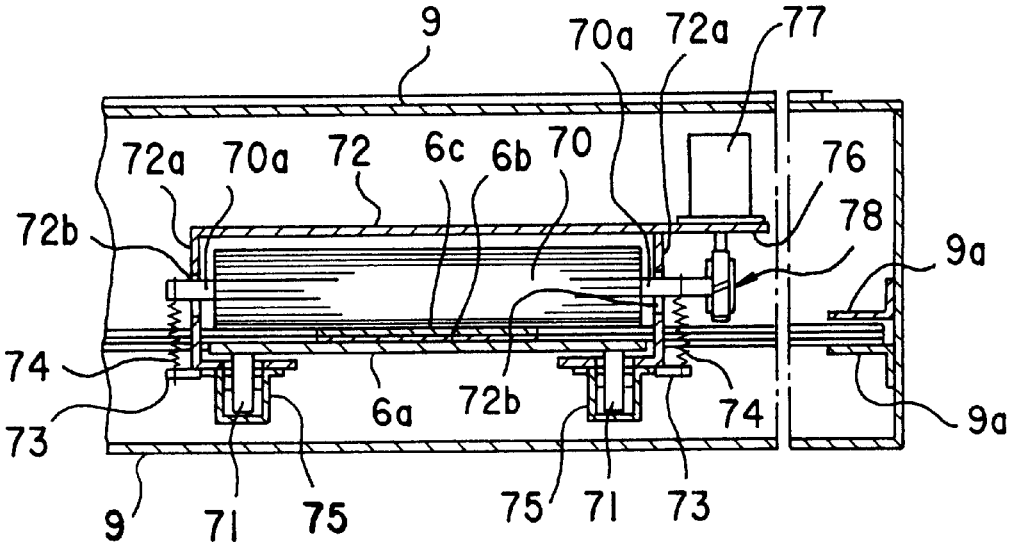
FIG. 13 is a sectional view taken on line A—A of FIG. 12.
Figure 14:
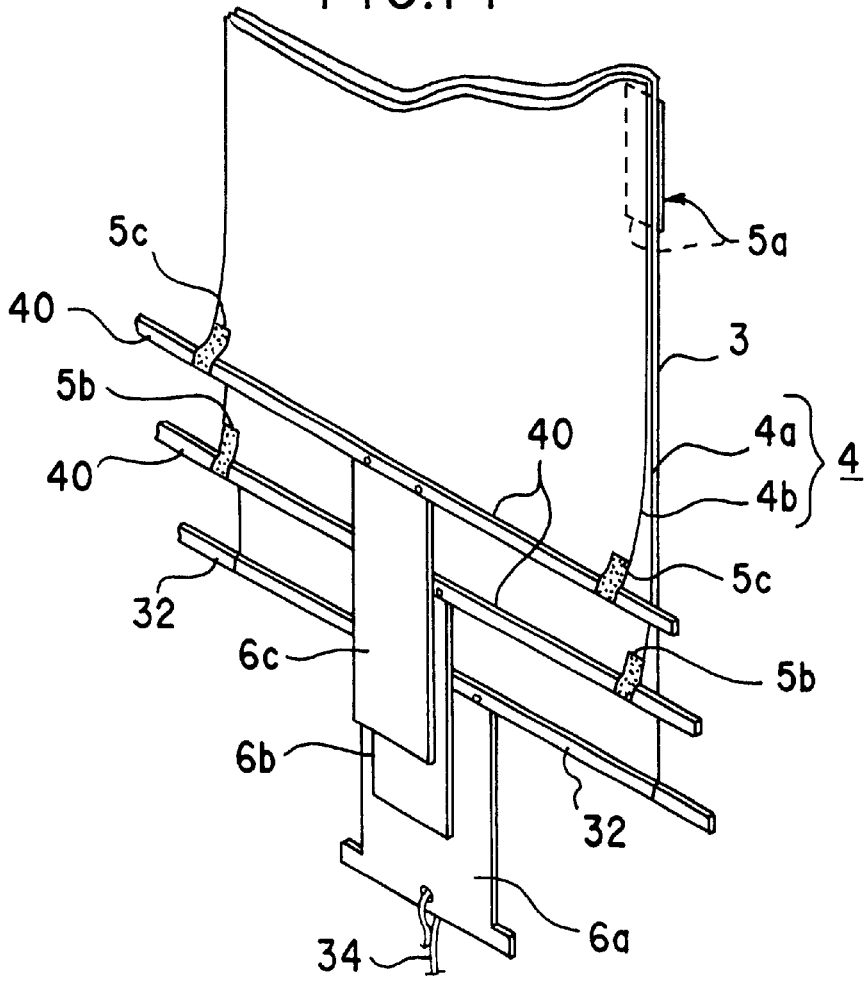
FIG. 14 is a perspective view illustrative of a portion of each screen of FIG. 12 rolled down.
Figure 15:
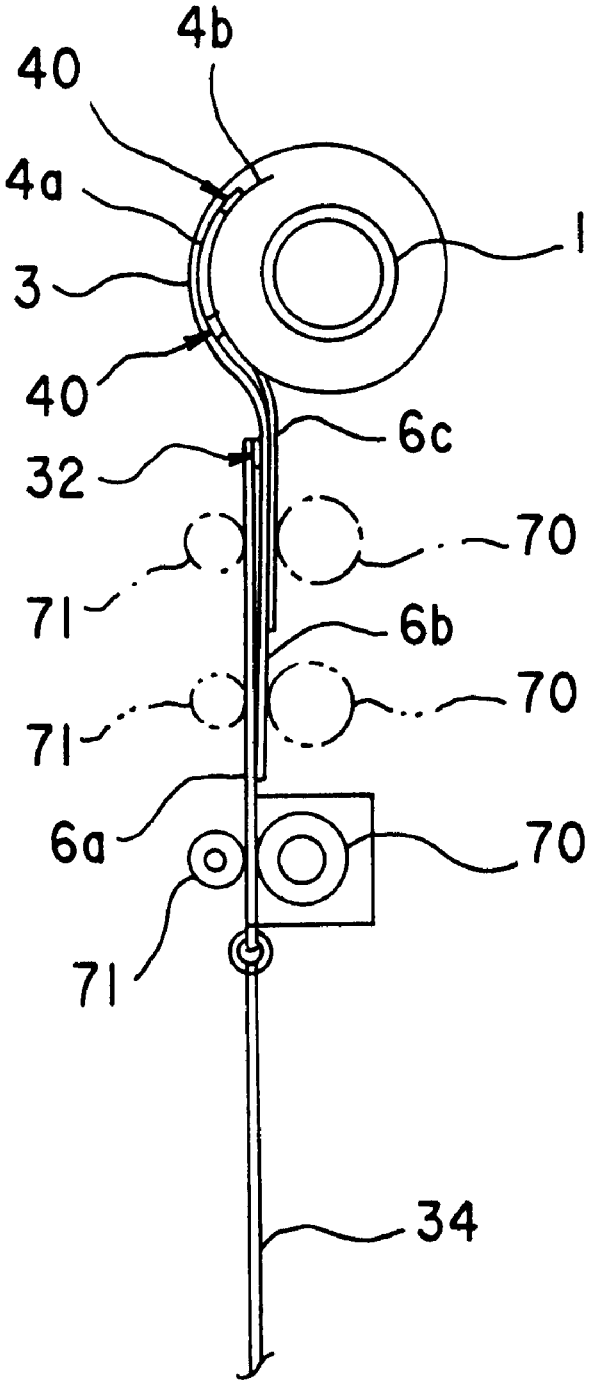
FIG. 15 is illustrative of how to operate the drawer of FIG. 12.

FIGS. 12 to 15 show together a further embodiment of the rolled screen drawer according to the invention. FIG. 12 is a longitudinally sectioned view of this embodiment, FIG. 13 is a sectional view taken on line A—A of FIG. 12, FIG. 14 is a perspective view of a portion of each screen rolled-down, and FIG. 15 is illustrative of how to operate the drawer of FIG. 12. The same parts as in the embodiment of FIG. 3 are indicated by the same numerals, and so the explanations thereof are omitted.

The rolled screen drawer according to this embodiment of the invention is designed to roll down or rewind each screen in an automatically controlled mode using a motor, as in the embodiment of FIG. 9, with the selective operation carried out via an operating switch or remote controller connected to the drawer.

AS shown in FIG. 12, the rolled screen drawer according to this embodiment is housed in a case 9. In FIG. 12, the right side thereof represents a front (display) side. In the case 9 that is a support member, a take-up roll 1 is rotatably mounted at an upper site while a pull-out roll 8 is again rotatably mounted at a lower site. A transparent display window 90 is located at a portion of the display side of the case 9, which corresponds to the effective display ranges of screens 3, 4*a* and 4*b*. FIG. 12 shows that all the screens 3, 4*a* and 4*b* are full rolled down. On both sides of the interior of the case 9 there are provided a pair of parallel guides 9*a* and 9*a* (see FIG. 13 too) along the rolling-down region of each screen 3, 4*a*, 4*b*. When each screen 3, 4*a*, 4*b* is rolled down, the ends of a reinforcing bar 32, 40 thereof are guided along the guides 9*a* and 9*a*.

The reinforcing bar 32 located at the leading end of the first screen 3 is provided substantially at its center with a hard sheet form of leading member 6*a* extending along the leading direction. The reinforcing bar 40 of each of the second screens 4 (4*a*, 4*b*) is provided substantially at its center with a leading member 6*b*, 6*c* comprising an elastic or flexible sheet extending along the rolling-down direction.

The leading members 6*b*, 6*c* of the second and third screens 4*a*, 4*b* are designed such that they overlap the leading member 6*a* upon rolling-down and the leading member 6*c* of the third screen 4*b* is shorter than the leading member 6*b* of the second screen 4*a* in the overlapping length with respect to the leading member 6*a*. To be more specific, the rolling-down length of the first screen 3 having the leading member 6*a* is longest, the rolling-down length of the second screen 4*a* having the leading member 6*b* is medium, and the rolling-down length of the third screen 4*b* having the leading member 6*c* is shortest, as shown in FIG. 12. When slightly rolled down from the take-up roll 1, the overlapping length of the leading member 6*b* of the second screen 4*a* with respect to the leading member 6*a* is longer than the overlapping length of the leading member 6*c* of the third screen 4*b* with respect to the leading member 6*a*.

The leading member 6*a* is provided with disengagement means 7 which, when the engagement means 5*a*, 5*b* and 5*c* become detached, clamps together the leading members 6*b* and 6*c* of the second and third screens 4*a* and 4*b* provided with the engagement means 5*b* and 5*c* and the leading member 6*a*. As shown in FIGS. 12 and 13, this disengagement means 7 is built up of a hold-down roller 70 located on the front side of the leading member 6*a* and a back-up roller 71 located on the back side of the leading member 6*a*, between which the leading member 6*a* and the leading members 6*b*, 6*c* put thereon are clamped.

A hold frame 72 is provided to cover a lengthwise portion of the leading member 6*a* in its widthwise direction from the front side (the right side in FIG. 12 and an upper side in FIG. 13). In the hold frame 72, the hold-down roller 70 is located on the front side of the leading member 6*a* in such a way as to extend along its widthwise direction. The hold frame 72 is provided in both its side sheets 72*a* and 72*a* with oblong slots 72*b* and 72*b* extending vertically with respect to the leading member 6*a*, and a shaft 71*a* of the hold-down roll 70 projects from both oblong slots 72*b*. Each of the ends of the shaft 70*a* projecting from the slots 72*b* and 72*b* is provided with a pull spring 74 fixed at one end to a mount piece 73 on each side of the hold frame 70, so that the hold-down roller 70 is biased by these springs 74, 74 toward the leading member 6*a*.

The hold frame 72 is provided on both sides of its back surface with roller cases 75 and 75 opposite to the back surface of the leading member 6*a*. Located in each roller case 75 is the back-up roller 71 that comes in rolling contact with the back surface of the leading member 6*a* along its lengthwise direction. At the front and lateral side of the hold frame 72, a remote controllable, reversible motor 77 is mounted on a mount plate 76, and the output of this motor 77 is transmitted to the shaft 70*a* of the hold-down roller 70 via a gear 78.

Referring again to FIG. 12, the case 9 is provided at its lower side with a rotary shaft 80 on which the pull-out roll 8 is mounted. The leading member 6*a* is connected at its lower end to one end of a rope 34 which is wound at the other end on the pull-out roll 8. The take-up roll 1 and rotary shaft 80 are each connected to a reversible motor (not shown), thereby rolling down or rewinding the screens 3 and 4. It is acceptable to couple the take-up roll 1 to the rotary shaft 80 by means of a chain or belt, so that the take-up roll 1 or pull-out roll 8 can be rotated by a motor or a manual turning handle.

How to operate the rolled screen drawer according to this embodiment is now explained. In the instant embodiment, only the inside of each screen 3, 4*a*, 4*b* is selectively exposed to view. As the second and third screens 4*a* and 4*b* are full wound on the take-up roll 1 by rotating the take-up roll 1, the leading ends of the second and third screens 4*a* and 4*b* are put by the respective engagement means 5*a*, 5*b* and 5*c* into a state where they can engage the outside of the first screen 3.

Operation 1

To expose the inside of the first screen 3 to view, the motor 77 shown in FIG. 22 is actuated to clamp only the leading member between the rollers 70 and 71 of the disengagement means 7 (as indicated by a solid line in FIG. 15). Then, the rotary shaft 80 is rotated in the take-up direction of the rope 34 (the rolling-down direction of the screen 3) to roll down the first screen 3 until its effective display range corresponds to the display window 90. In this way, the leading ends of the second and third screens 4*a* and 4*b* are rolled down in engagement with the outside of the first screen 3, so that the inside of the first screen 3 can be exposed to view.

Operation 2

To expose to view the inside of the second screen 4*a* of the second screens 4, the motor 77 shown in FIG. 12 is first actuated in the state where the second and third screens 4*a* and 4*b* are full wound on the take-up roll 1 to move the rollers 70 and 71 of the disengagement means 7 to where the leading member 6*a* overlaps the second screen 4*a,* as shown by two-dot chain lines in FIG. 15. Then, the rotary shaft 80 is rotated in the take-up direction of the rope 34 to roll down the second screen 4*a* until its effective display range corresponds to the display window 90. In this way, the leading end of the third screen 4*b* is rolled down in engagement with the back surface of the first screen 3, so that the front surface of the second screen 4*a* can be exposed to view.

Operation 3

To expose to view the inside of the third screen 4*b* of the second screens 4, the motor 77 shown in FIG. 12 is first actuated in the state where the second and third screens 4*a* and 4*b* are full wound on the take-up roll 1 to move the rollers 70 and 71 of the disengagement means 7 to where the leading member 6*a* overlaps the leading ends 6*b* and 6*c* of the second and third screen 4*a* and 4*b,* as shown by one-dot chain lines in FIG. 15. Then, the rotary shaft 80 is rotated in the take-up direction of the rope 34 to roll down the third screen 4*b* until its effective display range corresponds to the display window 90, as shown in FIG. 12. In this way, the inside of the third screen 4*b* can be exposed to view, because both the leading ends of the second and third screen 4*a* and 4*b* are in no engagement with the outside of the first screen 3.

In the instant embodiment, the case 9 is longitudinally set up so as to pull down the screens in the vertical direction. However, it is understood that the case 9 may be horizontally disposed so as to pull out the screens in the horizontal direction. In the instant embodiment, the take-up roll 1 and pull-out roll 8 are driven by the motor. However, it is understood that the take-up roll 1 may be driven by means of a spring whereas the pull-out roll 8 may be driven by means of a motor.

The present invention has been described with reference to some embodiments. In what follows, how to use the rolled screen drawer of the invention is explained. The present invention may be applied to presenting the contents of educational materials and documents in various educational and learning sets, and providing service information and information on goods and exhibits inside or outside offices, restaurants, retail outlets, show rooms, gathering places, theaters, cinema houses, ships, airplanes (spacecraft), railway cars, automobiles and other buildings for the purpose of selectively exposing a plurality of screens carrying various pieces of information to observers' view. The embodiments of FIG. 1–5 and FIGS. 10–12 may also be used in the form of roll blinds for protecting windows from light.

Besides, the present invention may be used in the following forms.

Some of screens may be used as freely writable billboards.

If the screens are designed as projection screens, the projection screens and other pieces of information may then be selectively displayed.

If a part or the whole of screens are constructed of liquid crystal films, backlight films or the like, they may then be used as image displays.

If other screens are superposed on the screens which are partly or wholly formed of transparent films or nets, it is then possible to achieve a display device capable of displaying added information or roll blinds capable of altering colors, patterns, etc. by superposition.

The screens may be provided with printings, pictures, photographs, drawings, tapestries (mural decorations), etc. in such a manner that they may be selectively displayed at need.

If the screens are used as lighting reflecting plates for photography, cinematography and TV photography, colors, reflectivity, etc. can then be arbitrarily altered.

If the screens are used as film form of illumination devices, an appropriate selection may then be made therefrom.

Colors, patterns and materials may be selectively used for backgrounds for cinematography and the stage.

These forms of use may be applied in combination of two or more.

A bag form of pocket may be added to each screen. The display side of this pocket is formed of a transparent or network material, and is partially openable for insertion of items such as printings, drawings, pictures, photographs and tapestries. The pocket may be designed to cover a part or the whole of the screen or such pockets may be added to both sides of the screen. It is thus possible to present such items without recourse to any adhesive tape.

As can be understood from the foregoing, the present invention provides a rolled screen drawer comprising a plurality of screens having various functions and a take-up roll on or from which the plurality of screens, put one upon another, can be wound or rolled down, wherein at least one additional screen is engaged on or disengaged from the outside of the first screen, so that the first screen and at least one additional screen can be selectively exposed to view in a very easy, smooth manner.

I claim:

1. A rolled screen drawer comprising:

a take-up roll rotatably mounted on a support member, a first screen having a first-screen fastened end and a first-screen leading end opposite to the first-screen fastened end, the first-screen fastened end being attached to said take-up roll, whereby an inside surface of said first screen is windable onto said take-up roll, at least one additional screen, including an additional-screen fastened end that is fastened adjacent to the first-screen fastened end, such that said additional screen is adjacent to the inside surface of said first screen, wherein the additional screen includes an additional-screen leading end opposite to the additional-screen fastened end; and an engagement means releasably engaging the additional-screen leading end of said at least one additional screen with an outside surface of said first screen, and wherein the additional-screen leading end comprises a leading member.

2. A rolled screen drawer comprising:

a take-up roll rotatably mounted on a support member, a motor for driving said take-up roll in a reversible manner, a first screen having a first-screen fastened end and a first-screen leading end opposite to the first-screen fastened end, the first-screen fastened end being attached to said take-up roll, whereby an inside surface of said first screen is windable onto said take-up roll, at least one additional screen, including an additional-screen fastened end that is fastened adjacent to the first-screen fastened end, such that said additional screen is adjacent to the inside surface of said first screen, wherein the additional screen includes an additional-screen leading end opposite to the additional-screen fastened end; and first engagement means comprising electromagnets, which is provided on an inside surface of the additional-screen end of said at least one additional screen, and second engagement means provided on an outside surface of said first screen for engagement with said first engagement means.

3. A rolled screen drawer comprising:

a take-up roll and a pull-out roll rotatably mounted on a support member, a first screen having a first-screen fastened end and a first-screen leading end opposite to the first-screen fastened end, the first-screen fastened end being attached to said take-up roll, whereby an inside surface of said first screen is windable onto said take-up roll, at least one additional screen, including an additional-screen fastened end that is fastened adjacent to the first-screen fastened end, such that said additional screen is adjacent to the inside surface of said first screen, wherein the additional screen includes an additional-screen leading end opposite to the additional-screen fastened end; and a first engagement means comprising electromagnets, which is provided on an inside of the additional-screen leading end of said at least one additional screen, a second engagement means comprising a magnetic material, which is provided on an outside surface of said first screen and engaged with said first engagement means, and a rope for coupling the first-screen leading end of said first screen to said pull-out roll.

4. A rolled screen drawer comprising:

a take-up roll rotatably mounted on a support member, a motor for rotating said take-up roll in a reversible manner, a first screen having a first-screen fastened end and a first-screen leading end opposite to the first-screen fastened end, the first-screen fastened end being attached to said take-up roll, whereby an inside surface of said first screen is windable onto said take-up roll, at least one additional screen, including an additional-screen fastened end that is fastened adjacent to the first-screen fastened end, such that said additional screen is adjacent to the inside surface of said first screen, wherein the additional screen includes an additional-screen leading end opposite to the additional-screen fastened end; and engagement means comprising a suction port, which is provided on an inside of the additional-screen leading end of said at least one additional screen, and a control valve and a vacuum pump connected to said suction port.

5. A rolled screen drawer comprising:

a take-up roll and a pull-out roll rotatably mounted on a support member, a first screen having a first-screen fastened end and a first-screen leading end opposite to the first-screen fastened end, the first-screen fastened end being attached to said take-up roll, whereby an inside surface of said first screen is windable onto said take-up roll, at least one additional screen, including an additional-screen fastened end that is fastened adjacent to the first-screen fastened end, such that said additional screen is adjacent to the inside surface of said first screen, wherein the additional screen includes an additional-screen leading end opposite to the additional-screen fastened end; and an engagement means releasably engaging the additional-screen leading end of said at least one additional screen with an outside surface of said first screen, wherein the first-screen leading end and the additional-screen leading end comprise respective leading members, a rope for coupling said leading member of said first screen to said pull-out roll, and disengagement means for giving a selective push on said respective leading members.

6. The rolled screen drawer of claim 1, wherein the additional-screen upper end of said additional screen is detachably fixed.

7. The rolled screen drawer of claim 1, wherein the additional-screen upper end of said additional screen is fixed to the inside surface of said first screen.

* * * * *